US007384036B2

(12) United States Patent
Kruijt

(10) Patent No.: US 7,384,036 B2
(45) Date of Patent: Jun. 10, 2008

(54) SHEET HANDLING DEVICE FOR WIDE FORMAT SHEETS

(75) Inventor: Pieter G. M. Kruijt, HE Eindhoven (NL)

(73) Assignee: OCE-Technologies B.V., Venlo (NL)

( * ) Notice: Subject to any disclaimer, the term of this patent is extended or adjusted under 35 U.S.C. 154(b) by 289 days.

(21) Appl. No.: 11/240,425

(22) Filed: Oct. 3, 2005

(65) Prior Publication Data

US 2006/0181012 A1 Aug. 17, 2006

(30) Foreign Application Priority Data

Oct. 4, 2004 (EP) ..... 04104861

(51) Int. Cl.
*B65H 29/24* (2006.01)
*B65H 29/32* (2006.01)
*B65H 5/00* (2006.01)

(52) U.S. Cl. ..... 271/194; 271/197; 271/276; 271/264; 271/94; 269/21; 355/73

(58) Field of Classification Search ..... 271/276, 271/194, 196, 197, 195, 264, 94; 226/95, 226/195; 269/21; 355/73
See application file for complete search history.

(56) References Cited

U.S. PATENT DOCUMENTS 3,222,051 A 12/1965 Bevilacqua et al.
3,527,166 A * 9/1970 Jaffa et al. ..... 101/474
3,584,954 A 6/1971 Nast
3,889,801 A * 6/1975 Boyer ..... 198/689.1
4,173,301 A 11/1979 Turini et al.
5,133,543 A 7/1992 Eitel et al.
5,810,350 A * 9/1998 Pollich ..... 271/276
6,254,092 B1 * 7/2001 Yraceburu et al. ..... 271/276
6,328,491 B1 * 12/2001 Beehler et al. ..... 400/648
6,367,999 B1 * 4/2002 Juan et al. ..... 400/645
6,394,596 B1 * 5/2002 Wotton et al. ..... 347/104
6,554,514 B2 * 4/2003 Wotton et al. ..... 400/648
6,739,254 B2 * 5/2004 Frankenberger et al. .... 101/232
6,927,841 B2 * 8/2005 Hinojosa et al. ..... 355/73
7,125,014 B2 * 10/2006 Dolz et al. ..... 271/197
2002/0110400 A1 8/2002 Beehler et al.

FOREIGN PATENT DOCUMENTS

EP 0 997 308 A2 5/2000

* cited by examiner

*Primary Examiner*—Patrick Mackey
*Assistant Examiner*—Luis A Gonzalez
(74) *Attorney, Agent, or Firm*—Birch, Stewart, Kolasch & Birch, LLP

(57) ABSTRACT

A sheet handling device for wide format sheets including a sheet support plate having a top surface containing suction holes which are connected to at least one suction chamber, the at least one suction chamber being divided into compartments that are connected, though an opening, to a suction device adapted to create a subatmospheric pressure in the compartments, wherein at least one internal wall between adjacent ones of the compartments defines a flow restriction orifice, and at least one of the compartments is directly connected to the suction device, and at least another one of the compartments is indirectly connected to the suction device through the orifice.

9 Claims, 3 Drawing Sheets

SHEET HANDLING DEVICE FOR WIDE FORMAT SHEETS

BACKGROUND OF THE INVENTION

The present invention relates to a sheet handling device for wide format sheets including a sheet support plate, said plate having a top surface containing suction holes which are connected to at least one suction chamber, said at least one suction chamber being divided into compartments that are connected to a suction device adapted to create a subatmospheric pressure in the compartments.

In the copying and printing industry, a sheet support element with suction holes is frequently used for supporting an image receiving sheet and at the same time ensuring that the sheet lies perfectly flat on the support element. For example, in an ink jet printer, a sheet, e.g. a sheet of paper, is advanced over a sheet support plate while the image is being printed. The sheet is held on the sheet support plate due to the subatmospheric pressure in the suction chamber which is connected to suction holes facing the bottom side of the sheet. A certain subatmospheric pressure is required to hold the sheet sufficiently flat on the support plate.

When sheets of different width are to be printed, the smaller sheets do not cover the sheet support element completely. Therefore, some of the suction holes are not covered. When the suction chamber is made of one large compartment extending over the whole area of the sheet support element, an air flow through the uncovered suction holes leads to an increase of the pressure in the suction chamber. This results in the sheet not being held firmly on the support element. If, on the other hand, a suction device of higher power is used to compensate for the increased air flow into the suction chamber, the suction will be too strong when all suction holes are covered by a large sheet, and the advance of the sheet over the support element is impeded.

From the European patent application EP 0 997 308 A2 a media hold down unit is known that comprises two or more vacuum chambers, a first vacuum chamber being directly connected to a vacuum source, while the other vacuum chambers are each connected to the vacuum source via separate bypass channels. The sizes of the chambers correspond to different widths of sheets that are to be handled. If one of the chambers is not covered by a sheet, an air flow is generated from this chamber through the bypass channel. The air flow affects the uniformity of the pressure inside the first vacuum chamber. Since the bypass channel and the first vacuum chamber are connected at an entrance into a conduit leading to the vacuum source, the uniformity of the pressure provided at the first chamber is affected only to a reduced extent. However, only a limited number of different sheet widths can be handled. Furthermore, for each partition of the support plate an extra bypass channel is needed and requires extra space.

SUMMARY OF THE INVENTION

It is an object of the present invention to provide a sheet handling device in which sheets of different sizes can be held down on a sheet support element with appropriate suction pressure, the sheet handling device being of simple and space saving construction.

According to the present invention, this object is achieved by a sheet handling device of the type indicated above, wherein at least one internal wall between adjacent ones of said compartments defines a flow restriction orifice, and at least one of said compartments is directly connected to the suction device, and at least another one of the compartments is indirectly connected to the suction device through said orifice.

The flow restricting orifices restrict the air flow from a compartment that is not covered by a sheet. Thus, the necessary subatmospheric pressure can be maintained in those compartments that are covered by the sheet. When, however, a sheet of larger size covers also the suction holes for which the flow path is restricted by the orifices, the flow rate will be reduced substantially. Thus, the effect of the flow resistance of the orifices will also be reduced, and the suction effect will be essentially uniform over the whole area of the sheet. Furthermore, no extra space is needed for bypass channels and the like. Another advantage is that the size of the compartments can be chosen by arranging the internal walls at appropriate positions in the suction chamber. Therefore, when manufacturing the sheet handling device, the sheet support place is readily adaptable to the required sizes of the compartments. Furthermore, since the internal walls do not require extra space outside of the suction chamber, the number of compartments may easily be increased. Therefore, the sheet handling device can readily be adapted to handle sheets of more than two sizes.

Preferably, the compartments are arranged symmetrically. Thus, the maximum distance of a compartment from the suction means is reduced as compared to, e.g., a configuration in which the suction device is connected to a first compartment in a chain of interconnected compartments. With this preferred arrangement, smaller sheets may be passed over the first compartment in a middle section of the sheet support plate instead of being fed at a lateral edge of the sheet support plate.

In a preferred embodiment, at least two groups of compartments are arranged in the direction of advance of the sheet, and only one group has a compartment that is directly connected to the suction device, whereas the compartments of the other group or groups are connected indirectly through flow restricting orifices. This helps to reduce the air flow into the suction chamber when a sheet covers only part of the support plate in the transport direction of the sheet. For example, when a new sheet is printed and advanced onto the sheet support plate, the sheet may already cover a compartment of the first group while the leading edge of the sheet has not yet reached a neighboring compartment of the second group.

One or more hollow spaces may be provided in the sheet support plate in order to reduce the weight of the plate and also its heat capacity, in the case that the temperature of the plate must be controlled, and yet to obtain a sufficient thickness and stability of the support plate. Then, the suction holes are preferably drilled in such positions that they lead into the hollow space which itself is connected to the compartments of the suction chamber by a number of apertures. As a result, an additional air flow would take place from one compartment to the other through the hollow space. It is therefore preferable that the internal wall separating these compartments comprises, for each of said hollow spaces, a protrusion extending through the aperture into said hollow space, so as to restrict the air flow through the hollow space.

DETAILED DESCRIPTION OF THE INVENTION

Preferred embodiments of the present invention will now be described in conjunction with the drawings, in which.

DETAILED DESCRIPTION OF THE INVENTION

Figure 1:
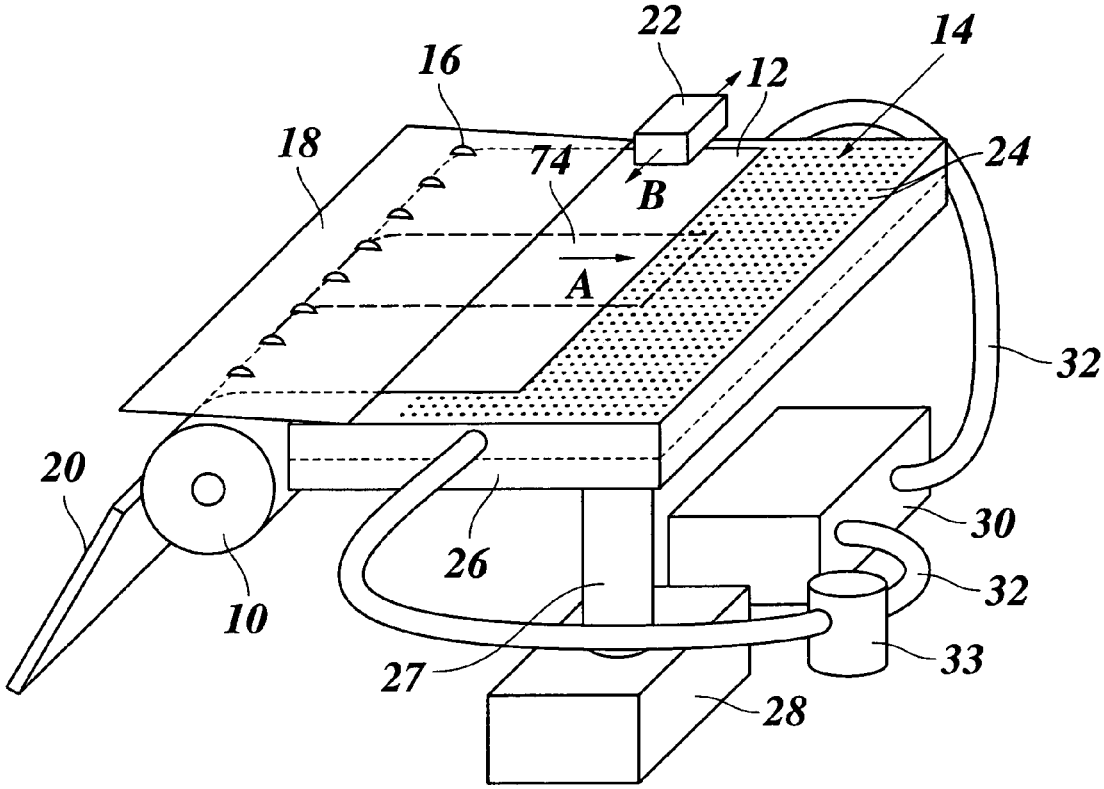
FIG. 1 is a schematic perspective view of a hot-melt ink jet printer.

As is shown in FIG. 1, a hot melt ink jet printer includes a platen 10 which is intermittently driven to rotate in order to advance a sheet 12, e. g. a sheet of paper, in a direction indicated by an arrow A over the top surface of a sheet support plate 14. A number of transport rollers 16 are rotatably supported in a cover plate 18 and form a transport nip with the platen 10, so that the sheet 12, which is supplied from a reel (not shown) via a guide plate 20, is paid out through a gap formed between an edge of the cover plate 18 and the surface of the sheet support plate 14.

A carriage 22 which includes a number of ink jet printheads (not shown) is mounted above the sheet support plate 14 so as to reciprocate in the direction of arrows B across the sheet 12. In each pass of the carriage 22, a number of pixel lines are printed on the sheet 12 by means of the printheads which eject droplets of hot melt ink onto the sheet in accordance with image information supplied to the printheads. For the sake of simplicity, guide and drive means for the carriage 22, ink supply lines and data supply lines for the printheads, and the like, have not been shown in the drawing.

The top surface of the sheet support plate 14 has a regular pattern of suction holes 24 which pass through the plate and open into a suction chamber 26 that is formed in the lower part of the plate 14. The suction chamber is connected via a tube 27 to a blower 28 which creates a subatmospheric pressure in the suction chamber, so that air is drawn-in through the suction holes 24. As a result, the sheet 12 is drawn against the flat surface of the support plate 14 and is thereby held in a flat condition, especially in the area which is scanned by the carriage 22. Thereby, a uniform distance between the nozzles of the printheads and the surface of the sheet 12 is established over the whole width of the sheet, and a high print quality can be achieved.

The droplets of molten ink that are jetted out from the nozzles of the printheads have a temperature of 100° C. or more and cool down and solidify after they have been deposited on the sheet 12. Thus, while the image is being printed, the heat of the ink must be dissipated with a sufficient rate. On the other hand, in the initial phase of the image forming process, the temperature of the sheet 12 should not be too low, because otherwise the ink droplets on the sheet 12 would be cooled too rapidly and would not have time enough to spread-out. For this reason, the temperature of the sheet 12 is controlled via the sheet support plate 14 by means of a temperature control system 30 which circulates a temperature control fluid, preferably a liquid, through the plate 14. The temperature control system includes a circulating system with tubes 32 that are connected to opposite ends of the plate 14. One of the tubes passes through an expansion vessel 33 containing a gas buffer for absorbing temperature-dependent changes in the volume of the liquid. As will be readily understood, the temperature control system 30 includes heaters, temperature sensors, heat sinks, and the like for controlling the temperature of the fluid, as well as a pump or other displacement means for circulating the fluid through the interior of the sheet support plate 14.

Figure 2:
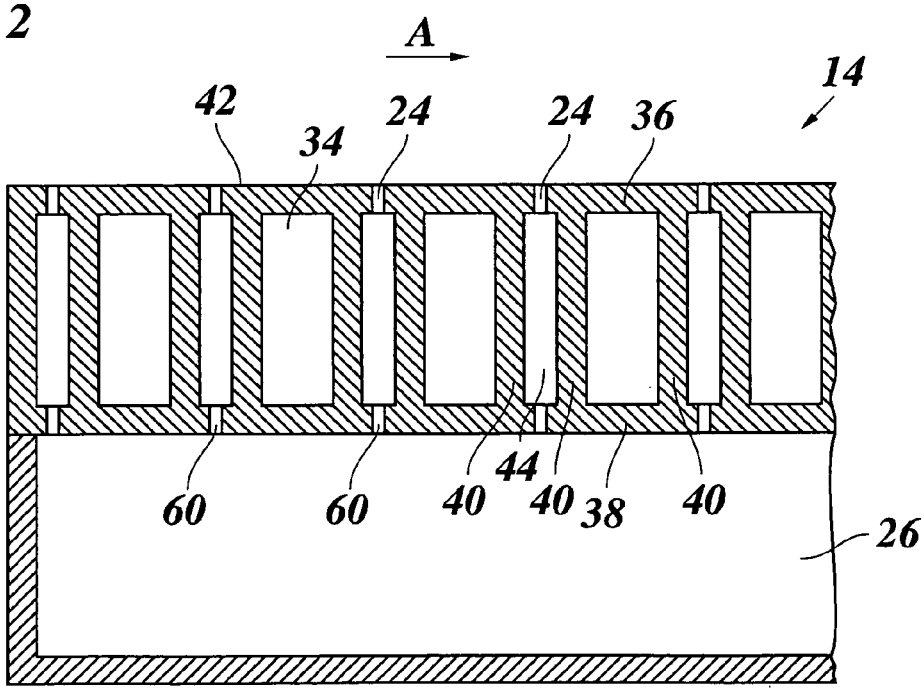
FIG. 2 is a partial cross section of a sheet support plate in the printer shown in FIG. 1.

The sheet support plate 14, which has been shown in cross-section in FIG. 2, is made of a material, such as a metal, having a relatively high heat conductivity and also a relatively high heat capacity. A number of elongated cavities 34 are formed in the interior of the plate 14 so as to extend in parallel with one another and in parallel with the direction (B) of travel of the carriage 22 between opposite ends of the plate 14, where they are connected to the tubes 32 through suitable manifolds. Each cavity 34 is delimited by a top wall 36, a bottom wall 38 and two separating walls 40. The top walls 36, together, define the top surface 42 of the plate 14 which is machined to be perfectly flat.

Between each pair of two separating walls 40, which delimit to adjacent cavities 34, a hollow space 44 is formed. The hollow spaces 44 extend parallel to each other and in parallel with the direction (B) of travel of the carriage 22 between opposite ends of the plate 14. The suction holes 24 pass through the top wall 36 into the hollow spaces 44. The hollow spaces 44 are connected to the suction chamber 26 via apertures 60 having the form of slits extending in the direction of the hollow spaces.

Figure 3:
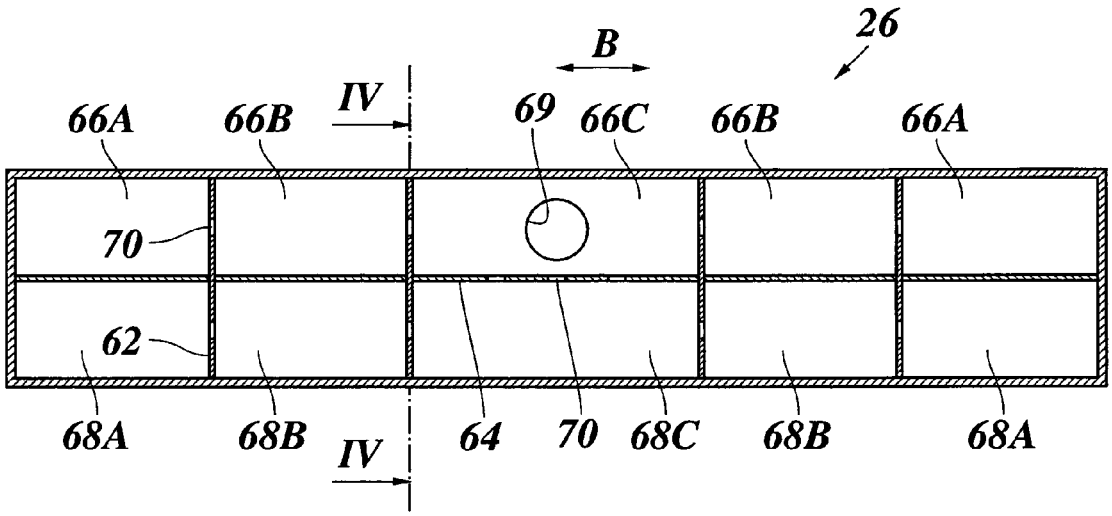
FIG. 3 is an enlarged section of a suction chamber of the sheet support plate, the section being taken along the line III-III in FIG. 4.

FIG. 3 schematically shows the interior of the suction chamber 26 in a horizontal cross-section. The suction chamber 26 comprises internal walls 62 extending in the sheet advance direction (A) and internal walls 64 extending in the reciprocating direction (B) of the printheads.

The internal walls 62 and 64 divide the suction chamber 26 into two groups of compartments 66A, 66B, 66C and 68A, 68B, 68C, respectively. The blower 28 is directly connected to the compartment 66C in the middle of the first group of compartments through an opening 69 and the tube 27 (FIG. 1). The compartment 68C is connected to its neighboring compartment 66C via three flow restricting orifices 70 of circular cross section in the wall 64. The compartments 66B and 68B are connected to the compartments 66C and 68C, respectively, through orifices 70 in the walls 62. The outermost compartments 66A and 68A are only connected to their neighboring compartments 66B and 68B within the same group of compartments via orifices 70 in the walls 62. However, the neighboring compartments 66A and 68A are not directly connected to each other. Also, the neighboring compartments 66B and 68B are not directly connected to each other, the compartments 66A, 66B, 68A, 68B and 68C are indirectly connected to the suction device through the orifices 70 and the compartment 66C.

When the sheet 12 is in the position of FIG. 1, it covers approximately the rectangular area of the first group of compartments 66A, 66B and 66C. The suction holes 24 which are connected to the second group of compartments 68A, 68B, 68C are not covered by sheet 12, so that air flows through the corresponding suction holes. However, the air flow to the compartment 66C is restricted by the flow restriction orifices 70. Thereby, the necessary subatmospheric pressure can be maintained in the compartments 66A, 66B and 66C.

Figure 4:
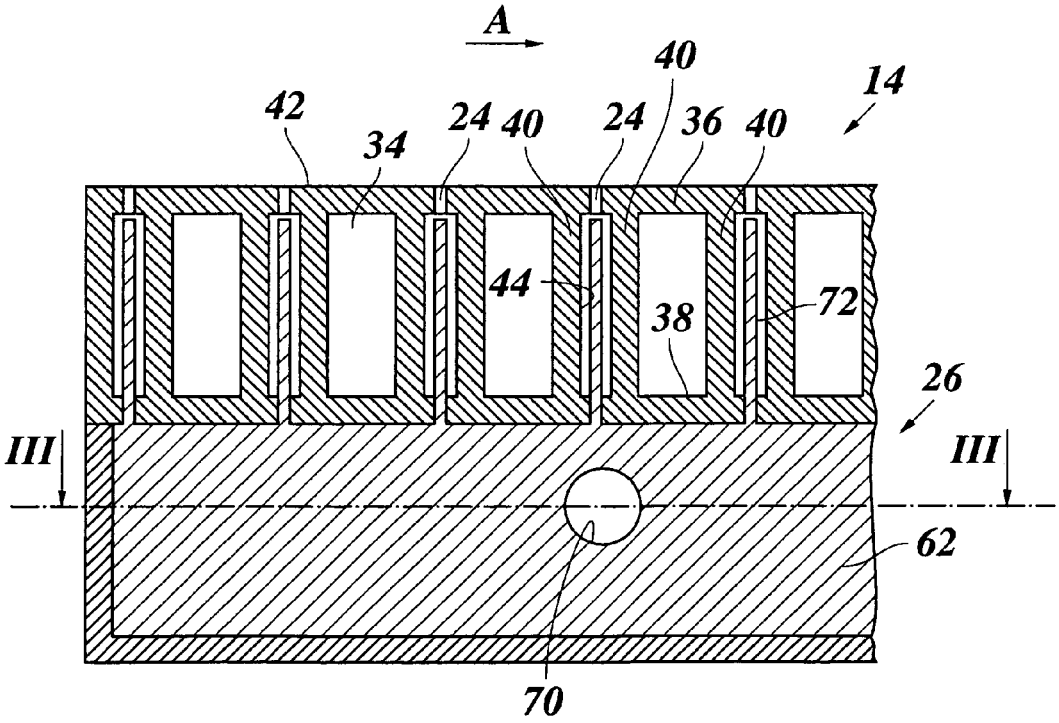
FIG. 4 is a partial cross section along the line IV-IV in FIG. 3.

FIG. 4 shows a cross sectional view of the sheet support plate 14 along the line IV-IV in FIG. 3. Unlike in FIG. 2, the cross section is through one of the walls 62. The orifice 70 connecting the compartments 66A and 66B is shown.

The walls 62 comprise a plurality of protrusions 72 extending upwards through the apertures 60 (FIG. 2) in the bottom wall 38 into the hollow spaces 44 up to the bottom of the top wall 36. Accordingly, air flow through the hollow spaces 44 is reduced by the protrusions 72 of the flow restricting members 62.

When a sheet 74 (FIG. 1) of small width is advanced over the sheet support plate 14, the sheet 74 covers, for example, only the area of the compartments 66C and 68C. The non-covered suction holes 24 which lie in the area of the compartments 66A, 68A, 66B, and 68B, permit an air flow into the hollow spaces 44. Then, the protrusions 72 restrict the air flow through the hollow spaces 44 from the area of the compartment 66A to the area of the compartment 66B, for example, and from the area of the compartment 66B to the area of the compartment 66C. At the same time, the orifices 70 restrict the air flow from the compartment 66A to the compartment 66B and from the compartment 66B to the compartment 66C. Thereby, the required subatmospheric pressure can be maintained in the compartment 66C.

Figure 5:
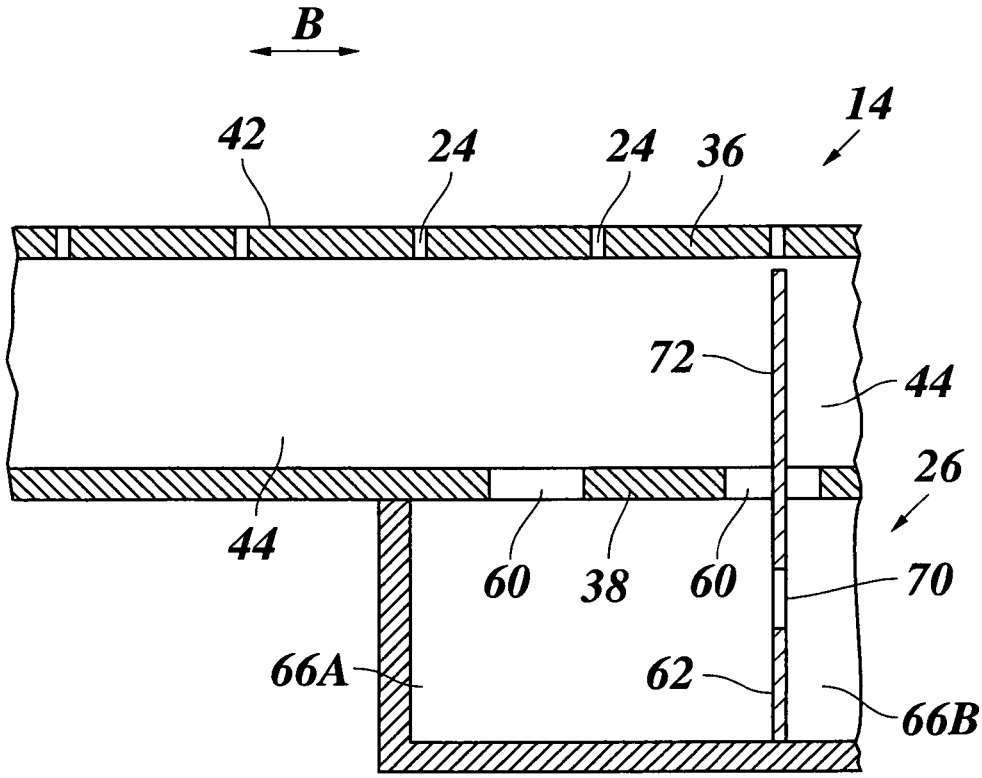
FIG. 5 is a partial cross section of a modified embodiment of the sheet support plate.

FIG. 5 shows a modified embodiment in a cross sectional view along a line that is parallel to the direction B. In this embodiment, the width of the suction chamber 26 is reduced as compared to the width of the sheet support plate 14. The outermost compartments 66A, 68A have a reduced size but nevertheless are connected to a similar surface area of the sheet support plate 14 as described in connection with FIGS. 1 to 4. This is achieved by the hollow spaces 44 connecting the respective suction holes 24 via the apertures 60 to the compartment 66A, for example. Thereby, the top surface 42 with the suction holes 24 can have a width that is larger than the width of the underlying suction chamber 26.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet handling device for wide format sheets comprising a sheet support plate, said sheet support plate having a top surface containing suction holes which are connected to at least one suction chamber, said at least one suction chamber being divided into compartments that are connected to a suction device adapted to create a subatmospheric pressure in the compartments wherein at least one internal wall between adjacent ones of said compartments defines at least one flow restriction orifice, and at least one of said compartments is directly connected to the suction device, and at least another one of the compartments is indirectly connected to the suction device through said orifice and wherein the sheet support plate has at least one hollow space interconnecting a plurality of said suction holes and extending over at least two adjacent compartments and being connected to these compartments through respective apertures, and wherein the internal wall separating these compartments includes, for each of said hollow spaces, a protrusion which extends through the aperture into said hollow space.

2. The sheet handling device of claim 1, wherein the compartments that are indirectly connected to the suction device are symmetrically arranged on opposite sides of the one compartment that is directly connected to the suction device.

3. The sheet handling device of claim 1 including a sheet transport mechanism for advancing a sheet in a first direction over said sheet support plate, wherein the compartments are arranged in at least two groups disposed in said first direction.

4. The sheet handling device of claim 1 including a sheet transport mechanism for advancing a sheet in a first direction over said sheet support plate, wherein the compartments are symmetrically arranged in a second direction, orthogonal to said first direction.

5. The sheet handling device of claim 1, wherein exactly one compartment is directly connected to the suction device.

6. The sheet handling device of claim 1, wherein the sheet support plate is made of a heat conductive material and has at least one cavity formed between the top wall and the bottom wall and separated from the hollow space by separating walls; the sheet handling device including a temperature control system including a circulating system for circulating a temperature control fluid through said cavity.

7. The sheet handling device of claim 1 wherein the top surface of the sheet support plate has a width larger than the width of the suction chamber.

8. A printer containing a sheet handling device according to claim 1.

9. The printer of claim 8, said printer being an ink jet printer.

* * * * *